US009276331B2

(12) United States Patent
Stadler et al.

(10) Patent No.: US 9,276,331 B2
(45) Date of Patent: Mar. 1, 2016

(54) PRINTED CIRCUIT BOARD TERMINAL

(71) Applicant: MCQ TECH GmbH, Blumberg (DE)

(72) Inventors: Hermann Stadler, Donaueschingen (DE); Eugen Hahn, Villingen-Schwenningen (DE)

(73) Assignee: MCQ TECH GmbH, Blumberg (DE)

( * ) Notice: Subject to any disclaimer, the term of this patent is extended or adjusted under 35 U.S.C. 154(b) by 0 days.

(21) Appl. No.: 14/589,512

(22) Filed: Jan. 5, 2015

(65) Prior Publication Data

US 2015/0303594 A1 Oct. 22, 2015

(30) Foreign Application Priority Data

Jan. 10, 2014 (DE) ..... 10 2014 200 271

(51) Int. Cl.

| | |
|---|---|
| ***H01R 4/48*** | (2006.01) |
| ***H01R 12/51*** | (2011.01) |
| ***H01R 11/18*** | (2006.01) |
| *H01R 13/629* | (2006.01) |

(52) U.S. Cl.

CPC ..... *H01R 4/4836* (2013.01); *H01R 11/18* (2013.01); *H01R 12/51* (2013.01); *H01R 12/515* (2013.01); *H01R 13/62938* (2013.01)

(58) Field of Classification Search

CPC ..... H01R 4/4827; H01R 4/4836; H01R 4/52
See application file for complete search history.

(56) References Cited

U.S. PATENT DOCUMENTS

| | | | | |
|---|---|---|---|---|
| 4,759,726 | A * | 7/1988 | Naylor | H01R 4/5008 439/441 |
| 8,262,422 | B1 | 9/2012 | Chiang | |
| 2003/0066673 | A1* | 4/2003 | Doutaz | H01R 4/4836 174/652 |
| 2008/0108254 | A1* | 5/2008 | Eppe | H01R 4/4836 439/729 |
| 2010/0081316 | A1* | 4/2010 | Eppe | H01H 1/5844 439/441 |
| 2012/0238156 | A1* | 9/2012 | Hayashi | H01R 4/4836 439/820 |

FOREIGN PATENT DOCUMENTS

| | | | |
|---|---|---|---|
| DE | 37 43 410 | A1 | 12/1987 |
| DE | 42 33 446 | C1 | 10/1992 |
| DE | 20 2012 103 690 | U1 | 9/2012 |
| DE | 10 2012 005465 | B3 | 5/2013 |
| EP | 2 434 581 | A1 | 4/2010 |
| JP | 2012-064 351 | A | 9/2010 |
| JP | 2012 064351 | A | 3/2012 |
| WO | WO 2011/068 113 | A1 | 12/2009 |
| WO | WO 2011/068113 | A1 | 6/2011 |
| WO | WO 2012/025818 | A1 | 3/2012 |

OTHER PUBLICATIONS

Search report attached to the office action of the German Patent Office for related German patent application 10 2014 200 271.0, issued Dec. 10, 2014.

Search report for related European patent application 14199768.4 issued Jun. 25, 2015.

* cited by examiner

*Primary Examiner* — Briggitte R Hammond

(74) *Attorney, Agent, or Firm* — Juneau & Mitchell

(57) ABSTRACT

The invention concerns a printed circuit board terminal with a housing with two frontal sides and at least one insertion opening arranged in one of the frontal sides, through which an electrical conductor can be inserted into the housing in one insertion direction.

16 Claims, 7 Drawing Sheets

PRINTED CIRCUIT BOARD TERMINAL

CROSS REFERENCE TO RELATED APPLICATIONS

This patent application claims priority to German Patent Application 10 2014 200 271.0, filed on Jan. 10, 2014.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The present invention relates to a printed circuit board terminal.

2. Background of the Invention

DE 10 2010 014 143 A1 and DE 10 2010 014 144 A1 reveal an electrical terminal for a clamping connection of at least one electrical conductor with an operating device which is formed as a pusher integral with the housing of the terminal. Due to the integral design of the operating element on the housing, this can break at the bending point after just a few operations. Furthermore, such an operating element is not easy to operate, especially not with one finger.

The problem underlying this invention is to build a genus specific printed circuit board connecting terminal, particularly of the kind that is easily to operate.

The problem of this invention is solved by a printed circuit board terminal with the characteristics described herein below.

BRIEF SUMMARY OF THE INVENTION

In a preferred embodiment, a printed circuit board terminal with a housing with two frontal sides and at least one insertion opening arranged in one of the frontal sides, through which an electrical conductor can be inserted into the housing in one insertion direction, with one contact element arranged in the housing and one clamp spring that is electrically connected to the contact element in the housing for clamping firmly an inserted electrical conductor against the contact element, and with an operating element for releasing an inserted electrical conductor, distinguished by the fact that the operating element that can be pivoted about a swivel axis is arranged on the housing, that the operating element has two limbs that are connected by an operating surface, whereby the swivel axis is arranged in an area of the free ends of the limbs and whereby one clamping section of the clamp spring, is arranged between the free ends of the limbs on the one hand and the operating surface on the other.

In another preferred embodiment, a printed circuit board terminal as described herein, wherein the clamp spring is arranged between the free ends of the limbs on the one hand and the operating surface on the other.

In another preferred embodiment, a printed circuit board terminal as described herein, wherein at least on one limb, preferably on both limbs, a contact surface which is designed for contact on a contact surface of the clamp spring is arranged in the area between the free ends of the limbs and the operating surface.

In another preferred embodiment, a printed circuit board terminal as described herein, wherein the contact surface is formed by a wall of a groove running in the direction from the frontal side to the frontal side in a side surface of the limb.

In another preferred embodiment, a printed circuit board terminal as described herein, wherein the limbs are arranged parallel to the side surfaces of the housing that connect the two frontal sides of the housing.

In another preferred embodiment, a printed circuit board terminal as described herein, wherein the operating surface of the operating element lies on one frontal side and the swivel axis of the operating element in the area of the opposite frontal side, in particular that the operating surface of the operating element lies on the frontal side opposite the insertion opening.

In another preferred embodiment, a printed circuit board terminal as described herein, wherein the clamp spring has a contour which interacts with a corresponding contour of the contact element for the fixing of the clamp spring on the contact element.

In another preferred embodiment, a printed circuit board terminal as described herein, wherein the housing has a ramp on each of the two opposing side surfaces which are particularly arranged in such a way that when pushing the operating element onto the housing, the two limbs of the operating element spread out and fold together again in a desired position.

In another preferred embodiment, a printed circuit board terminal as described herein, wherein, in the desired position, the ramp comes to rest in a recess in the side surface of the limb, which is arranged transverse to the direction running from the frontal side to the frontal side.

In another preferred embodiment, a printed circuit board terminal as described herein, wherein the operating element is swivel-mounted on the housing with the help of at least one bearing journal which meshes in a hole.

In another preferred embodiment, a printed circuit board terminal as described herein, wherein one hole each is arranged in the area of the free end of the limbs, in each of which a bearing journal meshes, whereby both the bearing journals are arranged on two side surfaces of the housing located opposite each other.

In another preferred embodiment, a printed circuit board terminal as described herein, wherein the contact element has a ribbed, fluted or sawtooth-like structure on at least one edge, which comes into contact with a contact surface of the housing while inserting the contact element into the housing.

In another preferred embodiment, a printed circuit board terminal as described herein, wherein an operating recess for inserting an operating tool is arranged on the operating surface, which preferably runs transverse to the longitudinal direction of the limb.

In another preferred embodiment, a printed circuit board terminal as described herein, wherein the housing has a test opening, which is arranged in particular is such a way such that through it the contact element can be contacted with a test probe, whereby the test opening is preferably arranged on the upper side of the housing.

In another preferred embodiment, a printed circuit board terminal as described herein, wherein the housing has an inspection opening, which is arranged in particularly in such a way such that it enables a visual check of whether the electrical conductor has been inserted into the printed circuit board terminal, whereby the inspection opening is preferably arranged on the upper side of the housing.

In another preferred embodiment, a printed circuit board terminal as described herein, wherein the contact element has at least one contact surface or at least one contact pin.

DETAILED DESCRIPTION OF THE INVENTION

Figure 1:
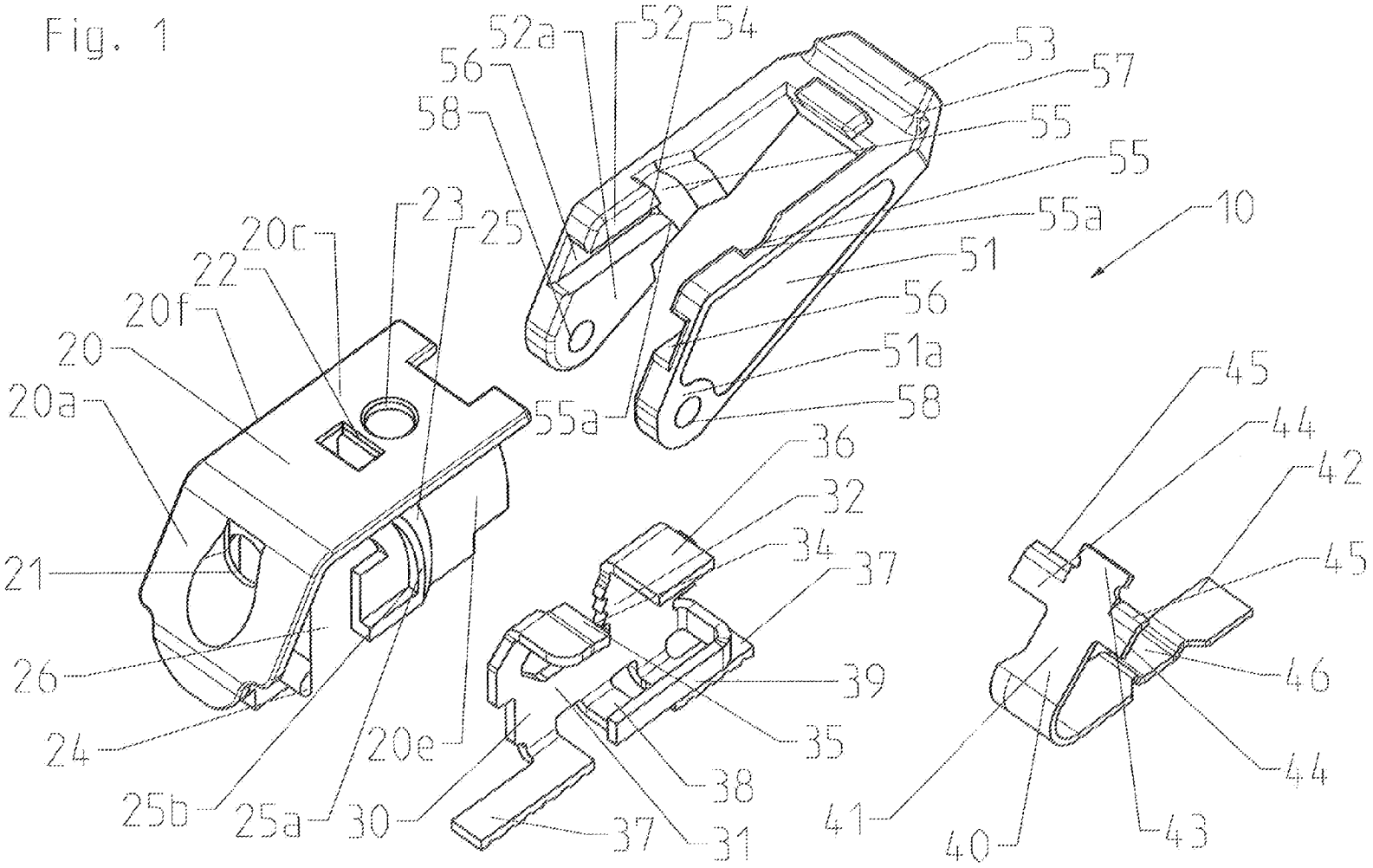
FIG. 1 is a line drawing evidencing an exploded representation of an embodiment of a printed circuit board terminal in accordance with this invention.
Figure 2:
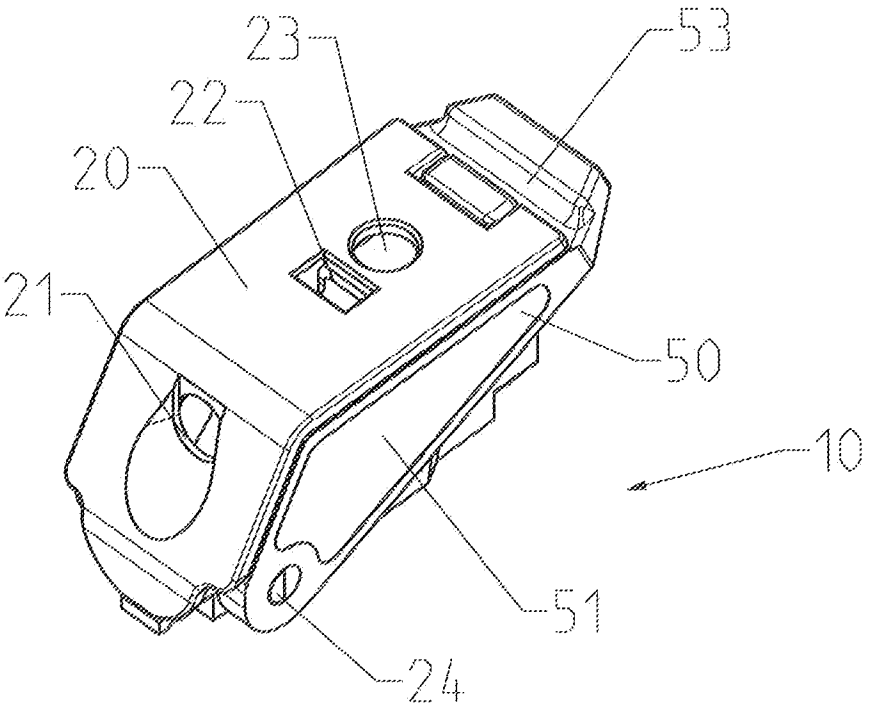
FIG. 2 is a line drawing evidencing a perspective representation of the printed circuit board terminal in accordance with FIG. 1 after assembly.
Figure 3:
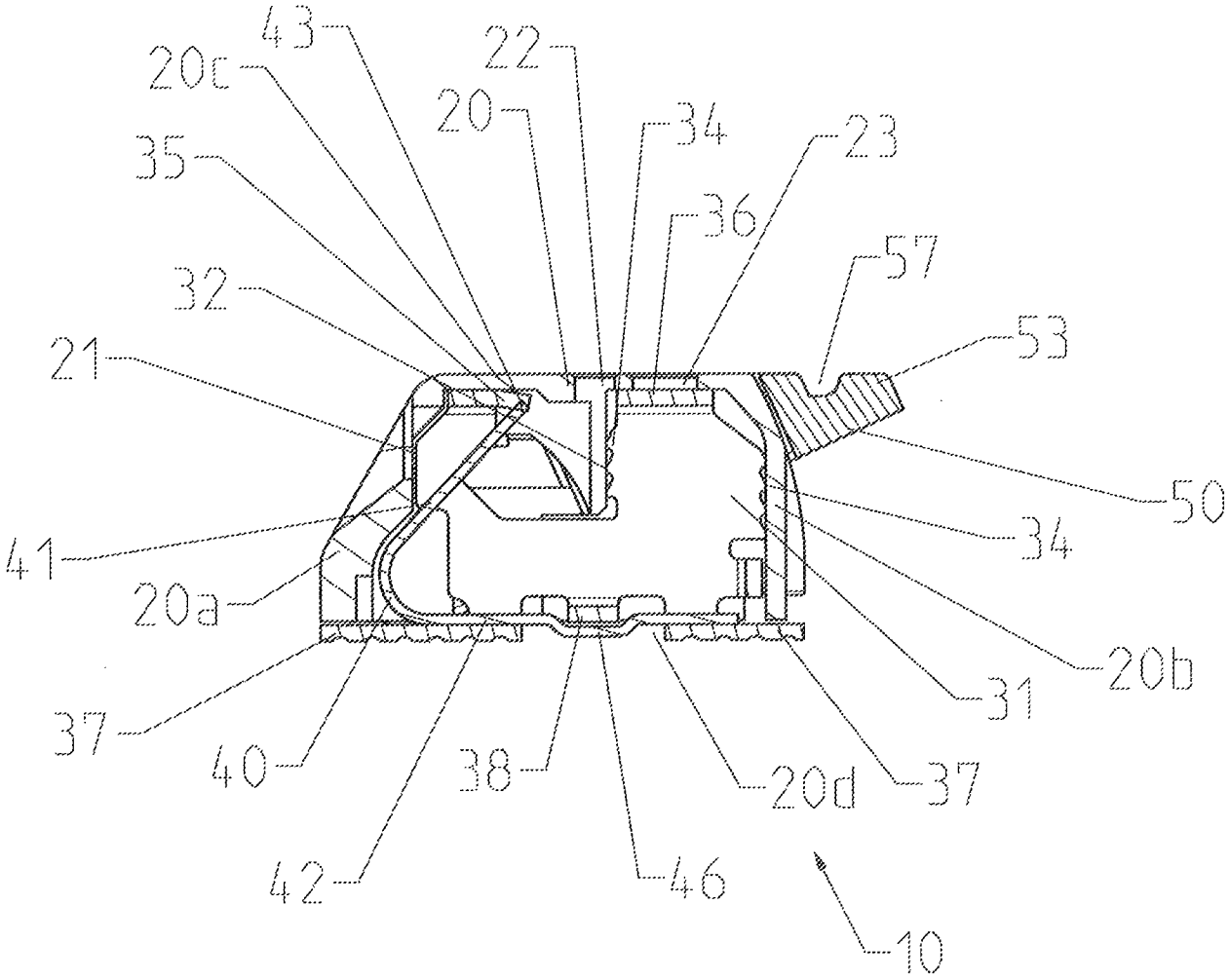
FIG. 3 is a line drawing evidencing a longitudinal section through the printed circuit board terminal in accordance with FIG. 2.
Figure 4:
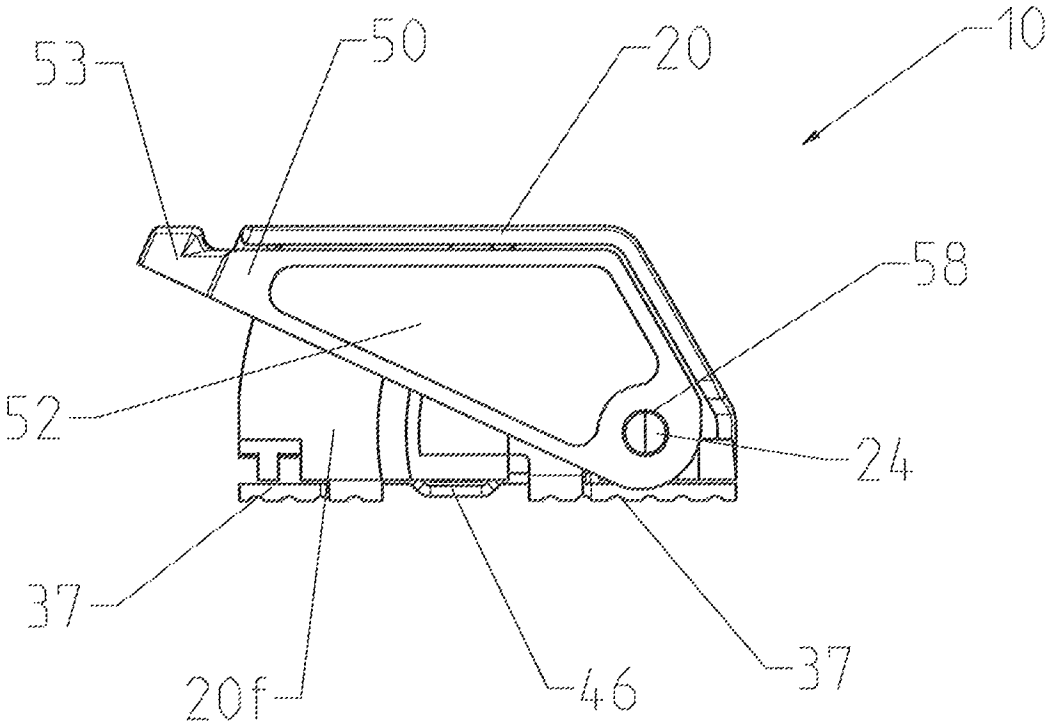
FIG. 4 is a line drawing evidencing a side view of the printed circuit board terminal in accordance with FIG. 2.
Figure 5:
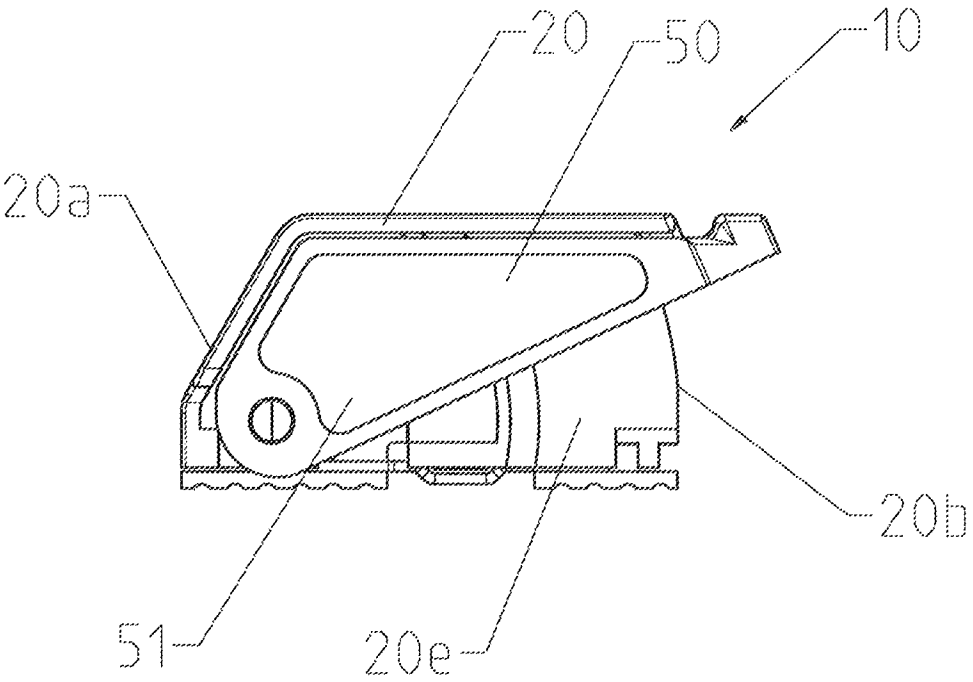
FIG. 5 is a line drawing evidencing another side view of the printed circuit board terminal in accordance with FIG. 2.
Figure 6:
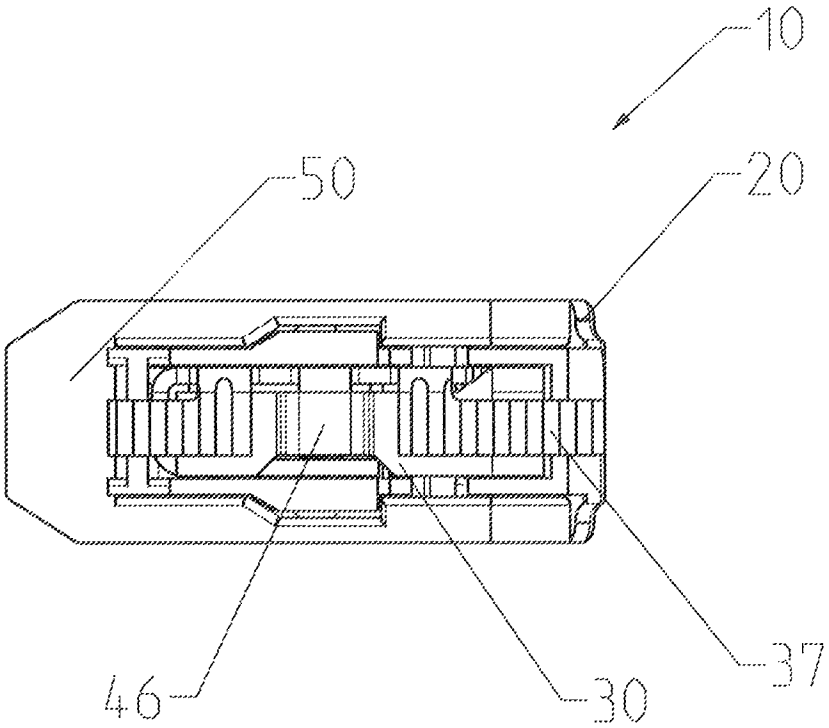
FIG. 6 is a line drawing evidencing a view from below on the printed circuit board terminal in accordance with FIG. 2.

According to this invention, the printed circuit board terminal with a housing with two frontal sides and at least one insertion opening arranged in one of the frontal sides, through which an electrical conductor can be inserted into the housing in one insertion direction, with one contact element arranged in the housing and one clamp spring that is electrically connected to the contact element for clamping the inserted electrical conductor firmly against the contact element, and with an operating element for releasing an inserted electrical conductor, is distinguished by the fact that the operating element that can be pivoted about a swivel axis is arranged on the housing, that the operating element has two limbs that are connected by an operating surface, whereby the swivel axis is arranged in an area of the free ends of the limbs and whereby one clamping section of the clamp spring, particularly the clamp spring, is arranged between the free ends of the limbs on the one hand and the operating surface on the other.

The swivel-mounting of the operating element on a swivel ax-is on the housing enables a large number of operations with-out danger of the operating element breaking at a bending point, since the operating element and the housing are two separate parts. Furthermore, the arrangement of the clamping section between the free ends of the limbs on which the swivel axis is arranged on the one hand, and the operating surface on the other, results in good leverage, so that good force transfer onto the clamping section of the clamp spring is possible without the user having to use much force. Thereby the design of the operating element facilitates a flat construction of the printed circuit board connecting terminal, since the operating surface of the operating element can be arranged in the area of one frontal side of the housing and thus particularly, the height of the housing is not increased by the operating element.

Advantageously, a contact surface is arranged on at least one limb, preferably on both limbs, in the area between the free end of the limb and the operating surface, which is designed for contact on a contact surface of the clamp spring. This enables a good transfer of force of the movement of the operating element onto the clamp spring.

According to a preferred embodiment of the invention, the contact surface is formed by a wall of a groove running in direction from frontal side to frontal side in one side surface of the limb, which makes a compact construction possible.

Advantageously, the limbs are arranged parallel to the side surfaces of the housing connecting the two frontal sides of the housing, which makes a compact construction of the printed circuit board terminal.

A particularly preferred embodiment of the invention provides that the operating surface of the operating element lies on one frontal side and the swivel axis of the operating element lies in the area of the opposite frontal side, particularly that the operating surface of the operating element lies on the frontal side that is opposite the insertion opening. The arrangement of the swivel axis of the operating element and the operating surface of the operating element in the area of the frontal sides located opposite to this, makes possible as long a limb as possible, by which the leverage is increased and the force required for operation can be reduced.

The clamp spring preferably has a contour which interacts with a corresponding contour of the contact element for the purpose of fixing the clamp spring onto the contact element. As a result of this a simple fixing of the clamp spring onto the contact element, particularly without additional components, is possible.

In accordance with a preferred embodiment of the invention, the housing has a ramp on each of the two side surfaces located opposite, which are notably arranged in such a fashion that they spread apart both the limbs of the operating element when the operating element is pushed towards the housing, and allow them to fold together again in a desired position. This enables a particularly simple assembly of the operating element on the housing.

Advantageously, in the desired position, the ramp comes to rest in a recess in the side surface of the limb, which is especially arranged in a direction transverse to the direction running from frontal side to frontal side. The arrangement of the ramp in a recess improves the compact construction of the printed circuit board terminal. The orientation of the recess, particularly transverse to the direction running from frontal side to frontal side enables, when swiveling the operating element, a relative movement between the ramp and the recess and particularly a guiding of the ramp in the recess and with that a guiding of the operating element on the housing.

Advantageously, the operating element is swivel-mounted on the housing with the help of at least one bearing journal which engages in a hole. Such a design of the swivel-mounting can be fabricated very easily and economically.

Advantageously, a hole is arranged in the area of the free end of the limb in which a bearing journal engages, whereby both bearing journals are arranged on two side surfaces located opposite each other. This enables a particularly stable mounting of the operating element on the housing.

An advantageous improvement of the invention provides that the contact element has a ribbed, fluted or sawtooth-like structure, which comes into contact with a contact surface of the housing when inserting the contact element into the housing, due to which a fixing of the contact element is enabled in a simple manner.

Advantageously, a recess, which runs preferably transverse to the longitudinal direction of the limb, is arranged on the operating surface for inserting an operating tool. Such a recess can prevent a slipping of an operating tool which can be used for operating the operating element and is of particular advantage in case the printed circuit board terminal is difficult to access.

An advantageous design of the invention provides that the housing has a test opening which is arranged in such a way that the contact element can be contacted with a test probe, whereby the test opening is preferably arranged on the upper side of the housing. A test opening enables, in a simple manner, a check of whether there is a voltage on the contact element. Since generally the upper side of the housing is the easiest to access, the arrangement of the test opening on the upper side of the housing is of advantage.

In accordance with an advantageous improvement of the invention, the housing has an inspection opening, which is particularly arranged in such a fashion as to enable a visual check of whether the electrical conductor is inserted into the printed circuit board terminal, whereby the inspection opening is preferably arranged on the upper side of the housing. Whether the electrical conductor has been correctly inserted into the printed circuit board terminal and has made contact can be checked in a simple manner through the inspection opening. Since generally the upper side of the housing is the easiest to access, an arrangement of the inspection opening on the upper side of the housing is of ad-vantage.

Preferably, the contact element has at least one contact surface, particularly for surface assembly, or at least a contact pin, particularly for assembly through the hole. The contact surface as well as the contact pin are thereby advantageously either led out through an opening of the housing or are accessible from outside through an opening of the housing so as to make the assembly easy.

DETAILED DESCRIPTION OF THE FIGURES

FIGS. 1 to 6 show different views of a first embodiment of a printed circuit board terminal 10. The printed circuit board terminal 10 has a housing 20 with two frontal sides 20*a*, 20*b* located opposite each other, an upper side 20*c*, a bottom side 20*d* and two side surfaces 20*e*, 20*f* located opposite each other. The housing 20 can hereby be formed essentially open towards the bottom side 20*d* as well as towards the rear frontal side 20*b*. The front frontal side 20*a* is preferably arranged inclined at an angle deviating from 90*o* against the upper side 20*c* and the bottom side 20*d*. The up-per side 20*c* can cantilever sideways over the side surfaces 20*e* and 20*f*.

The frontal side 20*a* is provided with an insertion opening 21 through which an electrical conductor can be inserted in-to the housing 20 in one direction of insertion.

A contact element 30 and a clamp spring 40 are arranged in the housing 20. The contact element 30 can have a side wall 31 which, when inserted into the housing 20, is arranged essentially parallel to one of the side surfaces 20*e*, 20*f*. A first flap which forms a contact surface 35 for an inserted electrical conductor can be arranged essentially at right angles on the side wall 31. Furthermore, a second flap which forms a contact surface 36 for an inserted electrical conductor can be arranged essentially at right angles on the side wall 31. When the contact element 30 is inserted into the housing 20, the contact surface 35 and the test surface 36 essentially lie parallel to the upper side 20*c* of the housing 20.

The upper side 20*c* of the housing can have a test opening 23 which, in the assembled condition of the contact element 30, is arranged above the test surface 36. The test surface 36 is thus accessible from the test opening 23, so that one can check in a simple manner with a test probe whether there is a voltage at the contact element 30. In one embodiment, the upper side 20*c* has an inspection opening 22. In the assembled condition of the contact element 30, one can look into the contact element 30 through the inspection opening 22 in such a manner, that it is possible to see the contact surface 35 and the inner area of the contact surface 30. In particular, whether an inserted conductor lies correctly within the contact element 30 and is brought into electrical contact with the contact surface 35 by the clamp spring 40, can be checked by a glance through the inspection opening 22.

Furthermore, at least one, and in the present embodiment two, contact surfaces 37 are arranged on the side wall 31. These can be arranged at right angles to the side wall 31, and in particular in such a fashion that they come to lie essentially on the bottom side 20*d* of the housing 20.

An end-stop bracket 39 can be arranged on the side wall 31, against which an electrical conductor that is inserted into the housing 20 through the insertion opening 21 comes into contact and which provides a limit to the degree of insertion.

The contact element 30 is fabricated out of a metallic con-ducting material, for example a copper alloy. Advantageously, the contact element 30 can be fabricated as a stamp and bend part.

For fixing the contact element 30 in the housing 20, the contact element 30 can have a saw-tooth structure 34 on one or several edges 32 which, for instance, run in the direction from the upper side 20*c* to the bottom side 20*d* in the housing 20 for the contact element 30 arranged in the housing 20, which comes into contact with one edge of the housing 20 and thus enable a fixing in the housing 20.

The contact element 30 is in electrical contact with the clamp spring 40. The clamp spring 40 is preferably fabricated out of a material with high spring tension, for example spring steel and in particular is formed as a stamp and bend part. The clamp spring 40 has a first limb 41 and a second limb 42 which are arranged at an acute angle to each other. The second limb 42, in the arrangement in the contact element 30 and the housing 20, is oriented essentially parallel to the bottom side 20*d*. So that the clamp spring 40 is fixed firmly in the contact element 30, a contour, for example in the form of an embossing 46, can be formed on the second limb 42, which interacts with a contour formed on the con-tact element 30, which for example is formed in the shape of a bridge and secures in particular the clamp spring 40 against slipping within the contact element 30, particularly while inserting the electrical conductor. The free end of the first limb 41 forms a clamping section 43 which presses an inserted electrical conductor against the contact surface 35 of the contact element 30. To improve the electrically conducting contact, an edge of the flap that forms the con-tact surface 35 can be bent against the free end of the first limb 41 of the clamp spring 40. When inserting an electrical conductor, the electrical conductor presses the first limb 41 against the force of the spring in the direction of the second limb 42 and is clamped and electrically contacted by the first limb 41 between the clamping section 43 and the contact surface 35 of the contact element 30.

On the first limb 41 of the clamp spring 40 at least one, preferably two flaps 44 are arranged, which are particularly arranged symmetrically on both sides of the longitudinal ax-is of the first limb 41 and in particular mostly in the plane of the first limb 41. An edge of the flap 44 pointing in the direction of the clamp section 43 of the first limb 41 of the clamp spring 40 can be bent, particularly in the direction of the second limb 42, to thus form a contact surface 45.

When the contact element 30 with the clamp spring 40 is inserted into the housing 20, the flaps 44 are advantageously accessible through the recesses 26 in the side surfaces 20*e*, 20*f*. These flaps 44 mesh, as described in more detail below, with an operating element 50 so as to enable the release of an electrical conductor connected in the housing 20.

The operating element 50 has a first limb 51 and a second limb 52, which are connected with each other at one end over an operating surface 53. This particularly results in an essentially U-shaped operating element 50. Both the limbs 51, 52 are essentially oriented parallel to each other and have a free end 51*a*, 52*a* each.

The operating element 50 is swivel mounted on the housing 20. For this purpose, the operating element 50 can have a hole 58 in the area of the free ends 51*a* and 52*a* of the limbs 51, 52, in each of which a bearing journal 24 that is arranged on the housing 20 engages. Thereby the bearing journals 24 are arranged on the side surfaces 20*e*, 20*f* located opposite each other, particularly in the area near the front frontal side 20*a*. The operating surface 53 is arranged in the area of the rear frontal side 20*b*, particularly out-side the housing 20. Both the limbs 51, 52 run essentially parallel to the side surfaces 20*e*, 20*f*. They particularly grip around the housing 20 on the outside. Particularly the limbs 51, 52 extend essentially over the entire length of the housing 20. This enables a large lever arm of the operating element 50.

The limbs 51, 52 each have a contact surface 54 in the area between the free end 51*a*, 52*a* and the operating surface 53, particularly on its inner side, which, in the assembled state of the printed circuit board terminal 10, bears on the flaps 44, particularly the contact surface 45 of the clamp spring 40. The contact surface 54 is particularly formed as a side wall of groove a 56 which, for example, is formed in the direction from the front frontal side 20*a* to the rear frontal side 20*b* in the limbs 51, 52. Thereby, the groove 56 extends particularly only over a longitudinal section of the limb 51, 52.

In the area between the first ends 51*a*, 52*a* and the operating surface 53, a recess 55 can be arranged on the inner side of the limb 51, 52 which, for example, is arranged running in the direction from the upper side 20*c* to the bottom side 20*d* on the housing 20 in the assembled state of the operating element 50. Particularly, groove 56 ends at the recess 55, while the recess 55 extends essentially over the entire width of limbs 51, 52.

For the assembly of the printed circuit board terminal 10, the clamp spring 40 is first fixed onto the contact element 30. For this, it is pushed in sideways in such a manner that the bridge 38 comes to rest in the embossing 46. Finally, the contact element 30 along with the spring clamp 40 is pushed into the housing 20 through the bottom side 20*d*. Thereby the saw-tooth shaped structures 34 grip onto the housing 20 to secure, in this manner, the contact element 30 in the housing 20. Finally, the operating element 50 is pushed over the housing 20 from the rear frontal side 20*b*, particularly against the direction of insertion.

In one embodiment, ascending ramps are arranged on the side surfaces 20*e*, 20*f* in the direction of the pushing movement of the operating element 50. These increase the width of the housing 20 in such a way that both the limbs 51, 52 of the operating element 50 are spread out during the pushing movement of the operating element 50 onto the housing 20. During the pushing movement particularly, the flaps 44 of the clamp spring 40, which protrude out of the housing 20 sideways through the recesses 26 in the side surfaces 20*e*, 20*f*, are guided in the grooves 56 along the limbs 51, 52. The ascending ramps 25 are restricted at the rear end in the pushing direction of the operating element 50 by a descending side wall 25*b*. The ramps 25 particularly are formed in such a way that they can be accommodated in the recesses 55 of the limbs 51, 52. As soon as the operating element 50 is pushed up so much that the ramps 25 can be accommodated in the recesses 55, the limbs 51, 52 fold together again. In this desired position, the operating element 50 is fixed in such a manner that the holes 58 on the free ends 51*a*, 52*a* of the limbs 51, 52 can be placed on the bearing journals 24 of the housing 20 and the operating element 50 is thus swivel-mounted onto the housing 20.

By pressing on the operating surface 53, the operating element 50 can be swiveled about a swivel axis which runs through both the bearing journals 24. Thereby the contact surface 54 of both the limbs 51, 52 press on the contact surface 45 of the clamp spring 40 and thereby moves the first limb 41 of the clamp spring 40 against spring force onto the second limb 42, so that the clamp end 43 of the first limb 41 of the clamp spring 40 releases the electrical conductor that is held clamped between the clamp end 43 and the contact surface 35 of the contact element 30, which can then be pulled out.

A guiding of the swivel movement of the operating element 50 can be improved if the side wall 25*b* of the ramps 25 is formed curved and correspondingly a side wall 25*a* of the recess 55 is likewise formed curved so as to enable a swiveling movement, and in particular a guided movement, of the of the operating element 50 along the ramp 25. Additionally, one surface 25*a* of the ramp 25 can also be formed curved.

The operating surface 53 of the operating lever 50 can have an operating recess 57 in which an operating tool can be inserted for operating the operating element 50. The operating recess 57 can particularly be formed as a groove running in the operating surface 53 transverse to both the limbs 51, 52.

The upper side 20*c* can cantilever over the side surfaces 20*e*, 20*f*. The limbs 51, 52 of the operating element 50 can be formed so flat that, due to the loaded status of the clamp spring 40, they lie flush on the cantilevering upper side 20*c* as well as on the frontal side 20*a*. Thereby, the cantilevering upper side 20*c* covers both the limbs 51, 52 of the operating lever 50.

Figure 7:
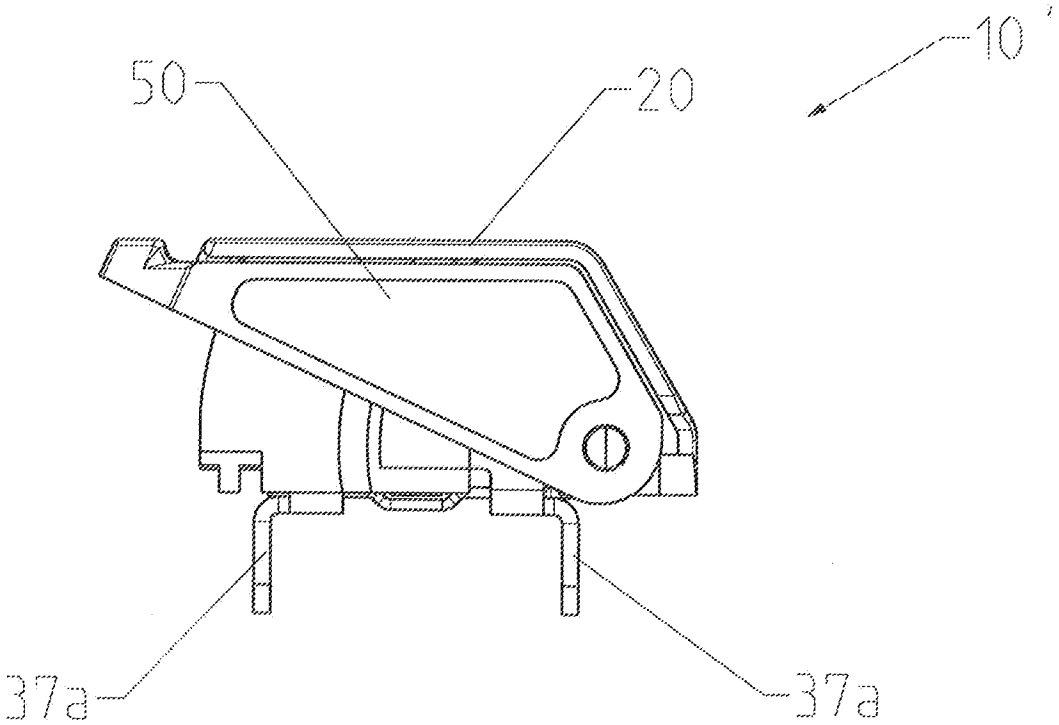
FIG. 7 is a line drawing evidencing a side view of another embodiment of a printed circuit board terminal in accordance with this invention.

FIG. 7 shows another example of an embodiment of a printed circuit board terminal 10' in accordance with this invention. The printed circuit board terminal 10' differs from the printed circuit board terminal 10 shown in FIGS. 1 to 6 only by the fact that the contact surfaces 37 are replaced by contact pins 37*a*. Contact surfaces 37 are used primarily for surface assembly, whereas contact pins 37*a* are used for assembly through the hole.

List of Reference Numbers:

10 Printed Circuit Board Terminal
10' Printed Circuit Board Terminal
20 Housing
20*a* Frontal side
20*b* Frontal side
20*c* Upper side
20*d* Bottom side
20*e* Side surface
20*f* Side surface
21 Insertion opening
22 Inspection opening
23 Test opening
24 Bearing journal
25 Ramp
25*a* Surface
25*b* Side wall
26 Recess
30 Contact element
31 Side wall
32 Edge
34 Saw-tooth like structure

35 Contact surface
36 Test surface
37 Contact surface
37*a* Contact pin
38 Bridge
39 End-stop bracket
40 Clamp spring
41 First limb
42 Second limb
43 Clamping section
44 Flap
45 Contact surface
46 Embossing
50 Operating element
51 First limb
51*a* Free end
52 Second limb
52*a* Free end
53 Operating surface
54 Contact surface
55 Recess
55*a* Side wall
56 Groove
57 Operating recess
58 Hole The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A printed circuit board terminal with a housing with two frontal sides and at least one insertion opening arranged in one of the frontal sides, through which an electrical conductor can be inserted into the housing in one insertion direction, with one contact element arranged in the housing and one clamp spring that is electrically connected to the contact element in the housing for clamping firmly an inserted electrical conductor against the contact element, and with an operating element for releasing an inserted electrical conductor, wherein the operating element that can be pivoted about a swivel axis is arranged on the housing, that the operating element has two limbs that are connected by an operating surface, whereby the swivel axis is arranged in an area of the free ends of the limbs and whereby one clamping section of the clamp spring, is arranged between the free ends of the limbs and the operating surface.

2. The printed circuit board terminal of claim 1, wherein the clamp spring is arranged between the free ends of the limbs and the operating surface.

3. The printed circuit board terminal of claim 1, wherein, at least on one limb, preferably on both limbs, a contact surface which is designed for contact on a contact surface of the clamp spring is arranged in the area between the free ends of the limbs and the operating surface.

4. The printed circuit board terminal of claim 1, wherein the contact surface is formed by a wall of a groove running in the direction from the frontal side to the frontal side in a side surface of the limb.

5. The printed circuit board terminal of claim 1, wherein the limbs are arranged parallel to the side surfaces of the housing that connect the two frontal sides of the housing.

6. The printed circuit board terminal of claim 1, wherein the operating surface of the operating element lies on one frontal side and the swivel axis of the operating element in the area of the opposite frontal side, in particular that the operating surface of the operating element lies on the frontal side opposite the insertion opening.

7. The printed circuit board terminal of claim 1, wherein the clamp spring has a contour which interacts with a corresponding contour of the contact element for the fixing of the clamp spring on the contact element.

8. The printed circuit board terminal of claim 1, wherein the housing has a ramp on each of the two opposing side surfaces which are particularly arranged in such a way that when pushing the operating element onto the housing, the two limbs of the operating element spread out and fold together again in a desired position.

9. The printed circuit board terminal of claim 1, wherein in the desired position, the ramp comes to rest in a recess in the side surface of the limb, which is arranged transverse to the direction running from the frontal side to the frontal side.

10. The printed circuit board terminal of claim 1, wherein the operating element is swivel-mounted on the housing with the help of at least one bearing journal which meshes in a hole.

11. The printed circuit board terminal of claim 1, further comprising wherein one hole is arranged in the area of the free end of each limb, in each of which a bearing journal meshes, whereby both the bearing journals are arranged on two side surfaces of the housing located opposite each other.

12. The printed circuit board terminal of claim 1, wherein the contact element has a ribbed, fluted or sawtooth-like structure on at least one edge, which comes into contact with a contact surface of the housing while inserting the contact element into the housing.

13. The printed circuit board terminal of claim 1, further comprising wherein an operating recess for inserting an operating tool is arranged on the operating surface, which preferably runs transverse to the longitudinal direction of the limb.

14. The printed circuit board terminal of claim 1, wherein the housing has a test opening, which is arranged in particular is such a way such that through it the contact element can be contacted with a test probe, whereby the test opening is preferably arranged on the upper side of the housing.

15. The printed circuit board terminal of claim 1, wherein the housing has an inspection opening, which is arranged in particularly in such a way such that it enables a visual check of whether the electrical conductor has been inserted into the printed circuit board terminal, whereby the inspection opening is preferably arranged on the upper side of the housing.

16. The printed circuit board terminal of claim 1, wherein the contact element has at least one contact surface or at least one contact pin.

* * * * *